US008403173B2

(12) United States Patent
Wahl et al.

(10) Patent No.: US 8,403,173 B2
(45) **Date of Patent: *Mar. 26, 2013**

(54) BEVERAGE CONTAINER CLOSURE

(75) Inventors: Andrew Wahl, Seattle, WA (US); Stephen Minarsch, Seattle, WA (US); Randy Sims, Franklin, TN (US)

(73) Assignee: Pacific Market International, LLC, Seattle, WA (US)

( * ) Notice: Subject to any disclaimer, the term of this patent is extended or adjusted under 35 U.S.C. 154(b) by 180 days.

This patent is subject to a terminal disclaimer.

(21) Appl. No.: 12/847,028

(22) Filed: Jul. 30, 2010

(65) Prior Publication Data

US 2012/0024854 A1 Feb. 2, 2012

(51) Int. Cl.
*B65D 83/00* (2006.01)
*B65D 43/26* (2006.01)

(52) U.S. Cl. ..... 220/715; 220/714; 220/262; 220/260; 215/387

(58) Field of Classification Search ..... 220/715, 220/262, 260; 222/478, 481
See application file for complete search history.

(56) References Cited

U.S. PATENT DOCUMENTS

| | | | | |
|---|---|---|---|---|
| 2,447,870 | A | 8/1948 | Polcyn | |
| 3,059,816 | A | 10/1962 | Goldstein | |
| 3,739,938 | A | 6/1973 | Paz | |
| 3,964,631 | A * | 6/1976 | Albert | 220/715 |
| 3,967,748 | A * | 7/1976 | Albert | 220/715 |
| 3,972,443 | A | 8/1976 | Albert | |
| 4,094,433 | A | 6/1978 | Numbers | |
| 4,099,642 | A | 7/1978 | Hergard | |
| 4,136,799 | A | 1/1979 | Albert | |
| 5,427,271 | A * | 6/1995 | Wang | 220/715 |
| 5,485,938 | A | 1/1996 | Boersma | |
| 6,098,834 | A * | 8/2000 | Hatsumoto et al. | 220/715 |
| 6,116,476 | A | 9/2000 | Huang | |
| 6,626,314 | B1 | 9/2003 | McHenry et al. | |
| 6,763,964 | B1 | 7/2004 | Hurlbut et al. | |
| 7,546,933 | B2 * | 6/2009 | Pinelli | 220/715 |
| 7,997,442 | B2 | 8/2011 | Pinelli | |

(Continued)

FOREIGN PATENT DOCUMENTS

| | | |
|---|---|---|
| JP | 09-150852 | 6/1997 |
| JP | 2009-279332 | 12/2009 |

(Continued)

OTHER PUBLICATIONS

U.S. Appl. No. 12/946,501, filed Nov. 15, 2010, Gilbert et al.

(Continued)

*Primary Examiner* — Anthony Stachick
*Assistant Examiner* — Jennifer Castriotta
(74) *Attorney, Agent, or Firm* — Davis Wright Tremaine LLP; George C. Rondeau, Jr.

(57) ABSTRACT

A beverage container closure or lid that is adapted for closing an open end of a beverage container. The lid is selectively couplable to the beverage container and includes a selectively openable stopper that when closed, creates a fluid-tight seal between the beverage container and the environment. The stopper may be selectively opened by a user when the user presses a button disposed on a side of the beverage container closure. The stopper is subsequently automatically closed when the user releases the button. Thus, a user may open and close the beverage container closure using a single hand without the need to remove the beverage container closure from the beverage container.

18 Claims, 8 Drawing Sheets

U.S. PATENT DOCUMENTS

| | | | | |
|---|---|---|---|---|
| 2005/0029265 | A1* | 2/2005 | Morgan et al. | 220/254.9 |
| 2006/0096983 | A1 | 5/2006 | Patterson | |
| 2006/0226160 | A1 | 10/2006 | Elsaden et al. | |
| 2008/0156817 | A1* | 7/2008 | Roseblade et al. | 220/713 |
| 2008/0237233 | A1* | 10/2008 | Choi et al. | 220/212.5 |
| 2008/0272134 | A1* | 11/2008 | Rohe | 220/713 |
| 2011/0309095 | A1 | 12/2011 | Pinelli | |

FOREIGN PATENT DOCUMENTS

| | | |
|---|---|---|
| KR | 20-1998-0061202 | 11/1998 |

OTHER PUBLICATIONS

U.S. Appl. No. 13/169,249, filed Jun. 27, 2011, Gilbert et al.
U.S. Appl. No. 13/226,669, filed Sep. 7, 2011, Shepard et al.
U.S. Appl. No. 13/311,373, filed Dec. 5, 2011, George.
International Search Report dated May 21, 2012, received in International Application No. PCT/US2011/060042, 3 pages.
European search report for Application No. EP12173632 dated Oct. 18, 2012.

* cited by examiner

BEVERAGE CONTAINER CLOSURE

BACKGROUND OF THE INVENTION

1. Field of the Invention

The present invention is directed generally to lids for liquid storage vessels such as for beverage or food containers and more particularly to lids with movable components.

2. Description of the Related Art

Prior art lids are typically of one of three types. The first type is a solid unitary lid that does not include openings or apertures through which the contents of a liquid storage vessel may exit the vessel. To drink from the vessel, a user must remove the lid. The second type, which may also be of a unitary construction, includes one or more unobstructed apertures through which the liquid may exit the vessel. In the second type, the apertures are always open. If the vessel is inadvertently tipped or dropped, the contents of the vessel may spill. The third type of lid includes one or more apertures through which the liquid may exit the vessel and a means for selectively opening and closing the apertures. When using the third type of lid, the user may selectively open the apertures to remove the contents from the vessel and selectively close the apertures to maintain the contents inside the vessel. Further, by closing the apertures, the lid may help insulate the contents from the environment outside the vessel.

DETAILED DESCRIPTION OF THE INVENTION

Figure 1:
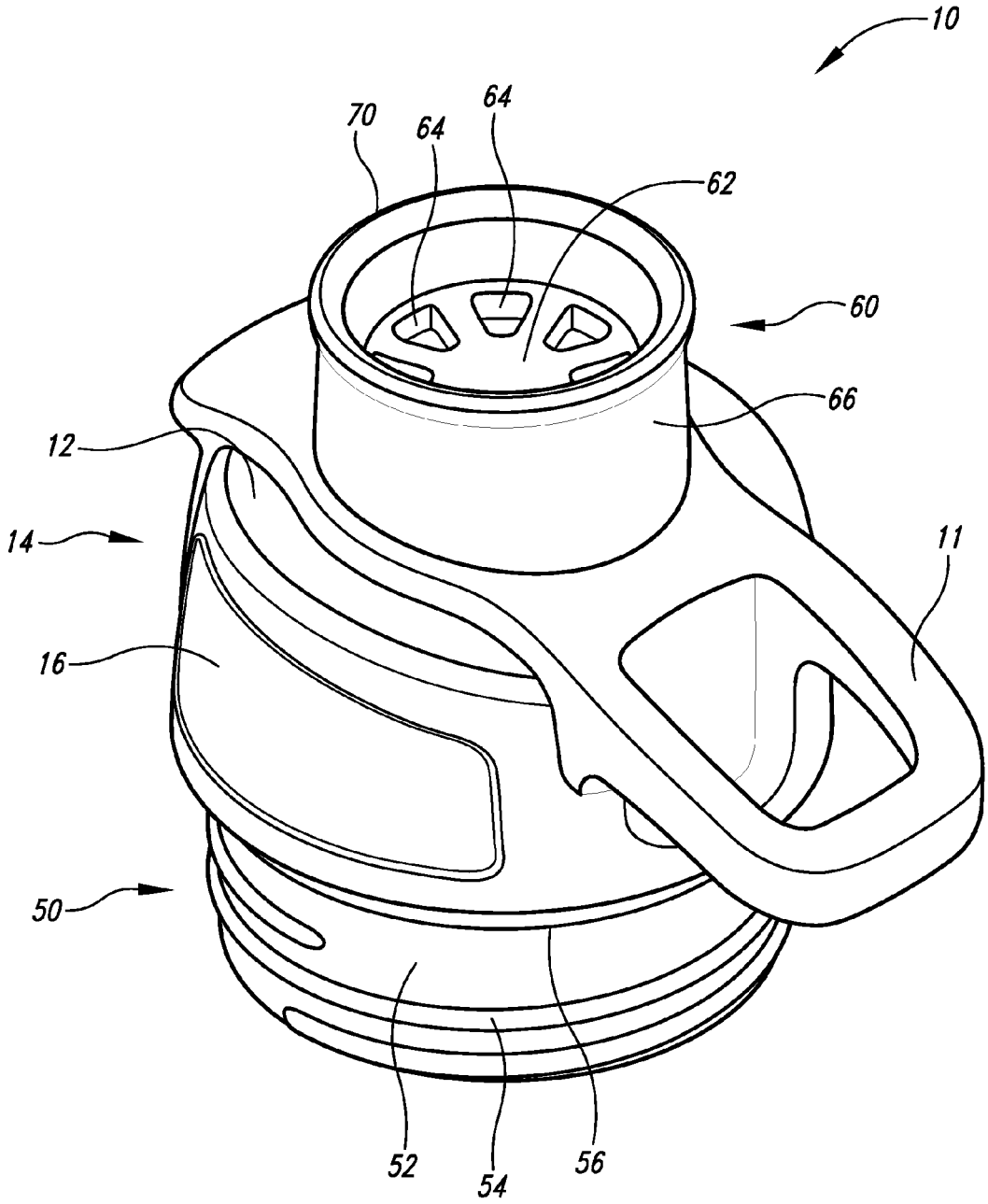
FIG. 1 is a top left side perspective view of a beverage container closure constructed in accordance with the present invention.

A beverage container closure or lid, in accordance with an embodiment of the present invention, is generally indicated at reference numeral 10 in FIG. 1. The lid 10 has a substantially circular main body 12 that is adapted for closing an open end of a conventional drinking vessel or beverage container (not shown). The beverage container may be any suitable type of container such as the tumbler type (that is, without a handle) for use in automotive beverage receptacles, or for transport in backpacks, book bags, and the like. The lid 10 is selectively couplable to a beverage container by any suitable means such as threads 54 disposed on an outer surface of a sidewall 52 of a lower, downwardly depending portion 50. The lid 10 also includes a flexible ring seal member 56 positioned adjacent the sidewall 52 of the lower portion 50 at a location near a bottom surface of an upper portion 14 of the main body 12. The particular configuration for mating the lid 10 to a container is a matter of choice for one of ordinary skill in the art. Thus, although threads 54 and the seal member 56 have been shown in this embodiment, those of ordinary skill in the art will appreciate that any other means for sealing the lid 10 with respect to a beverage container may be substituted.

The main body 12 also includes a raised top portion 60 integrally connected to the upper portion 14. The top portion 60 includes a substantially cylindrical sidewall portion 66 that includes a raised outwardly flaring circumferential lip 70 configured for contact with a user's lips when the entire assembly is tipped toward the user, such that the user may drink from a beverage container to which the lid 10 is attached from any direction. The top portion 60 also includes a plurality of apertures or openings 64 configured to permit fluid passage therethrough when a user drinks a beverage. As can be appreciated, the plurality of apertures 64 may provide for a more even flow of fluid from the beverage container.

Figure 2:
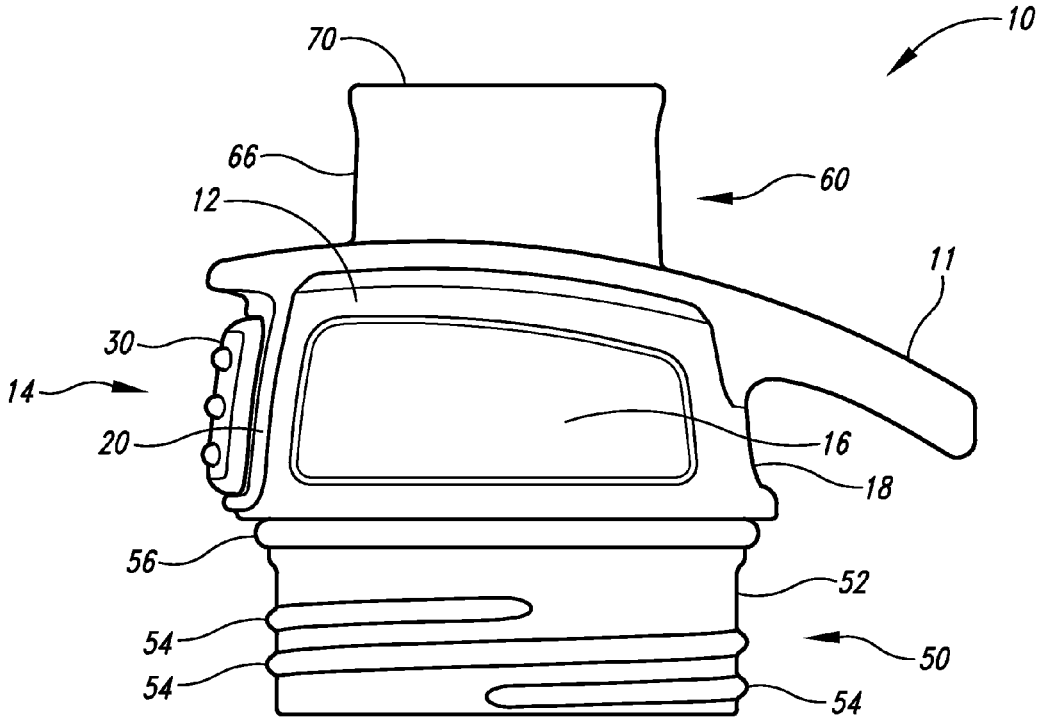
FIG. 2 is a left side elevational view of the beverage container closure of FIG. 1.
Figure 3:
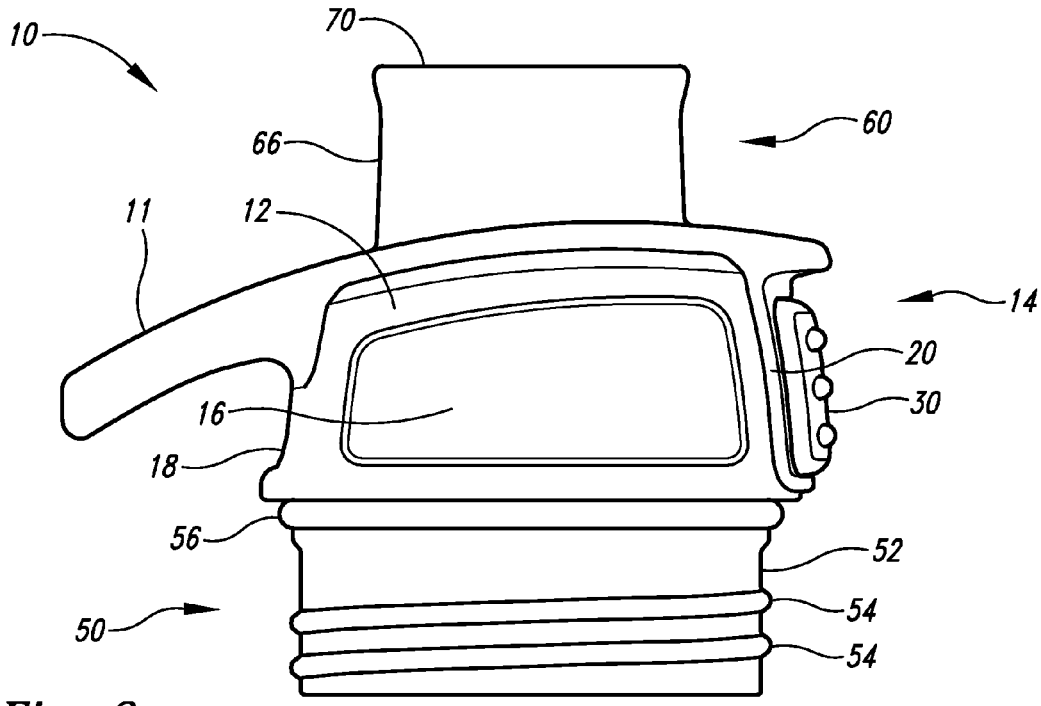
FIG. 3 is a right side elevational view of the beverage container closure of FIG. 1.
Figure 4:
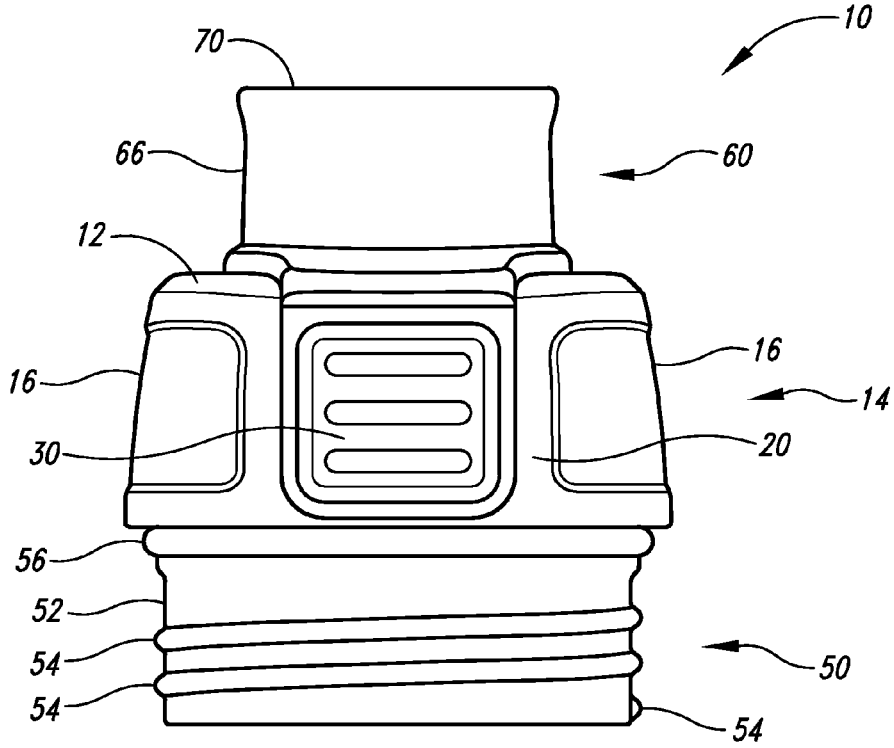
FIG. 4 is a front elevational view of the beverage container closure of FIG. 1.
Figure 5:
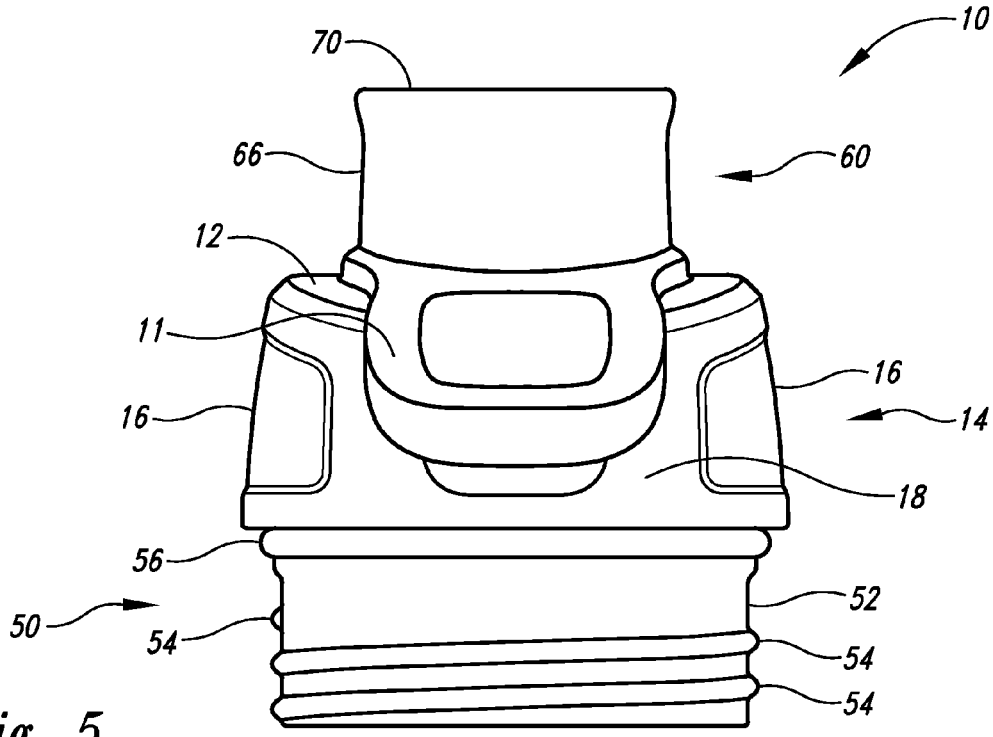
FIG. 5 is a rear elevational view of the beverage container closure of FIG. 1.
Figure 6:
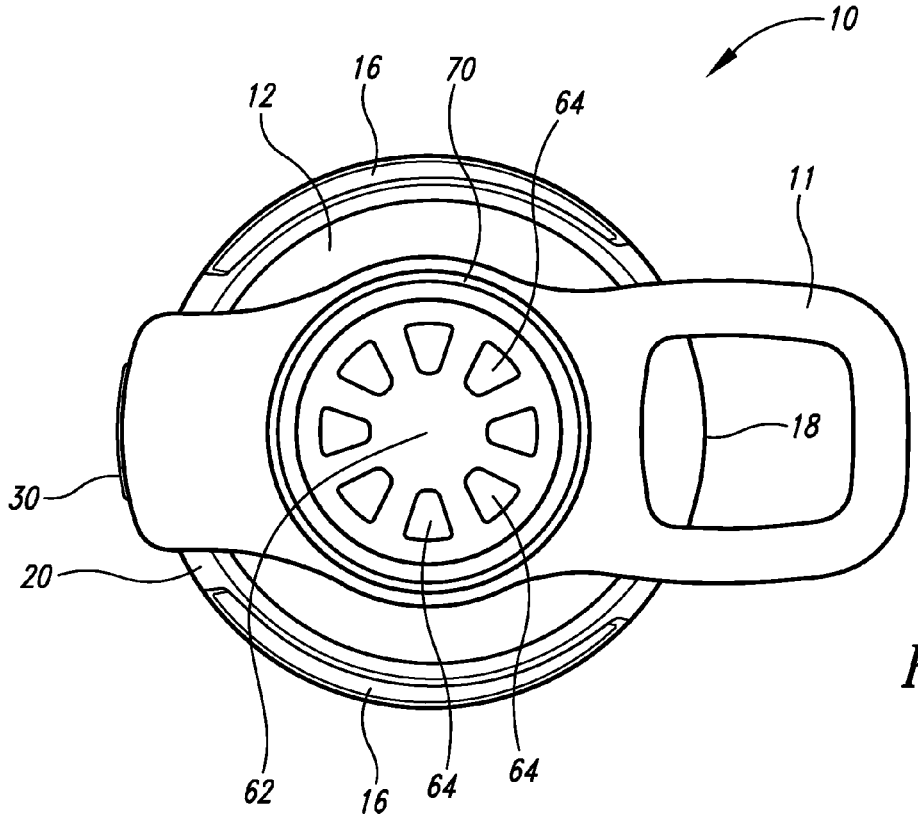
FIG. 6 is a top plan view of the beverage container closure of FIG. 1.
Figure 7:
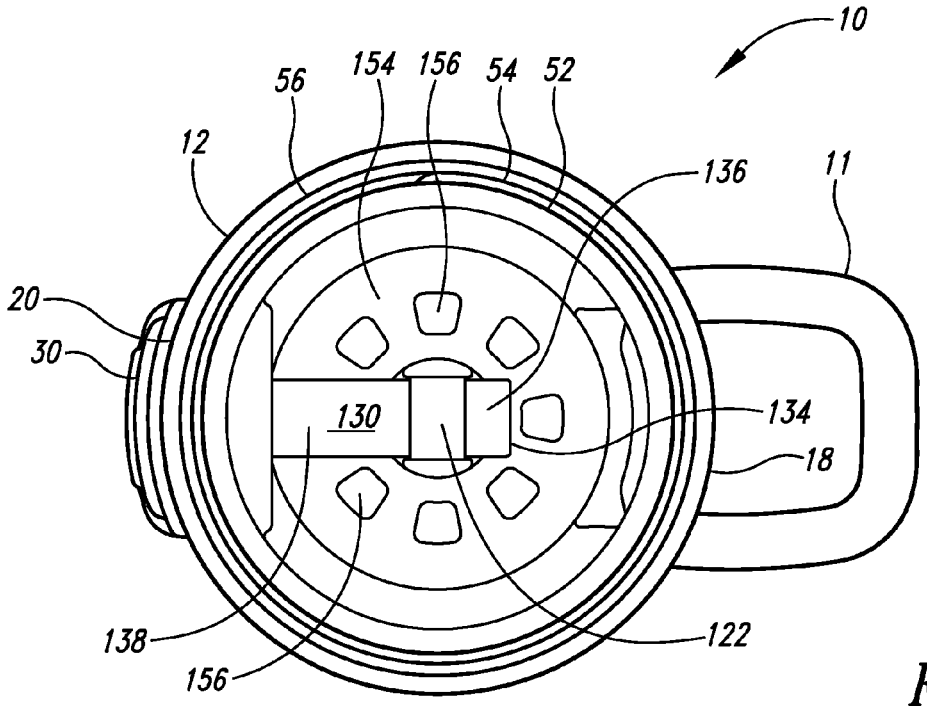
FIG. 7 is a bottom plan view of the beverage container closure of FIG. 1.

The main body 12 also includes a handle 11 disposed near a rear portion 18 (see FIGS. 2 and 3) of the main body. The handle 11 includes a loop portion configured to permit a user to carry the lid 10 or to connect the lid 10 to other objects. For example, a user may connect a metal loop such as a carabiner to the handle 11 so that the lid 10 may be removably connected to a belt, a backpack, a bicycle, or the like.

Figure 8:
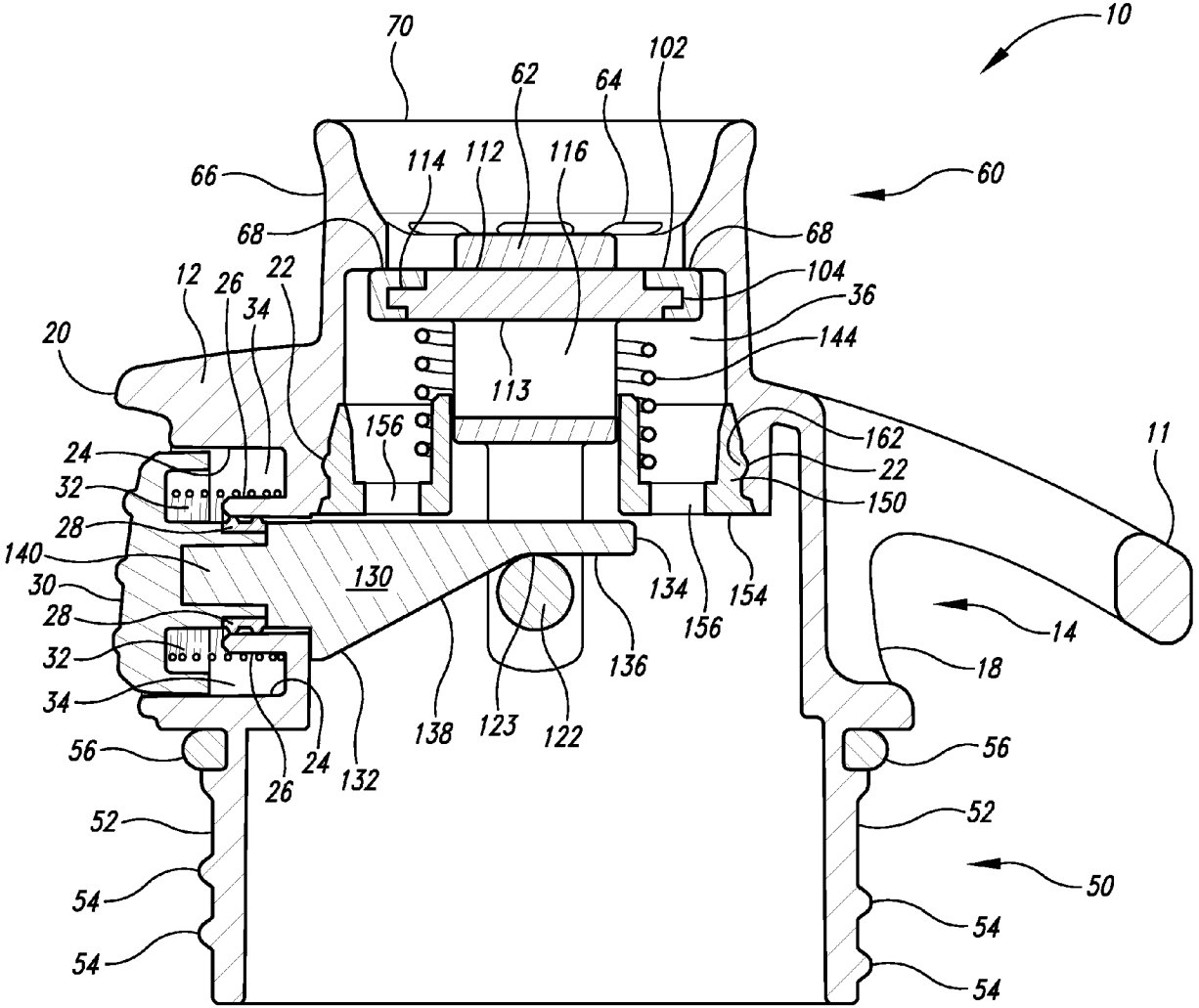
FIG. 8 is a cross-sectional left side elevational view of the beverage container closure of FIG. 1 when a stopper of the beverage container closure is in the closed position.
Figure 9:
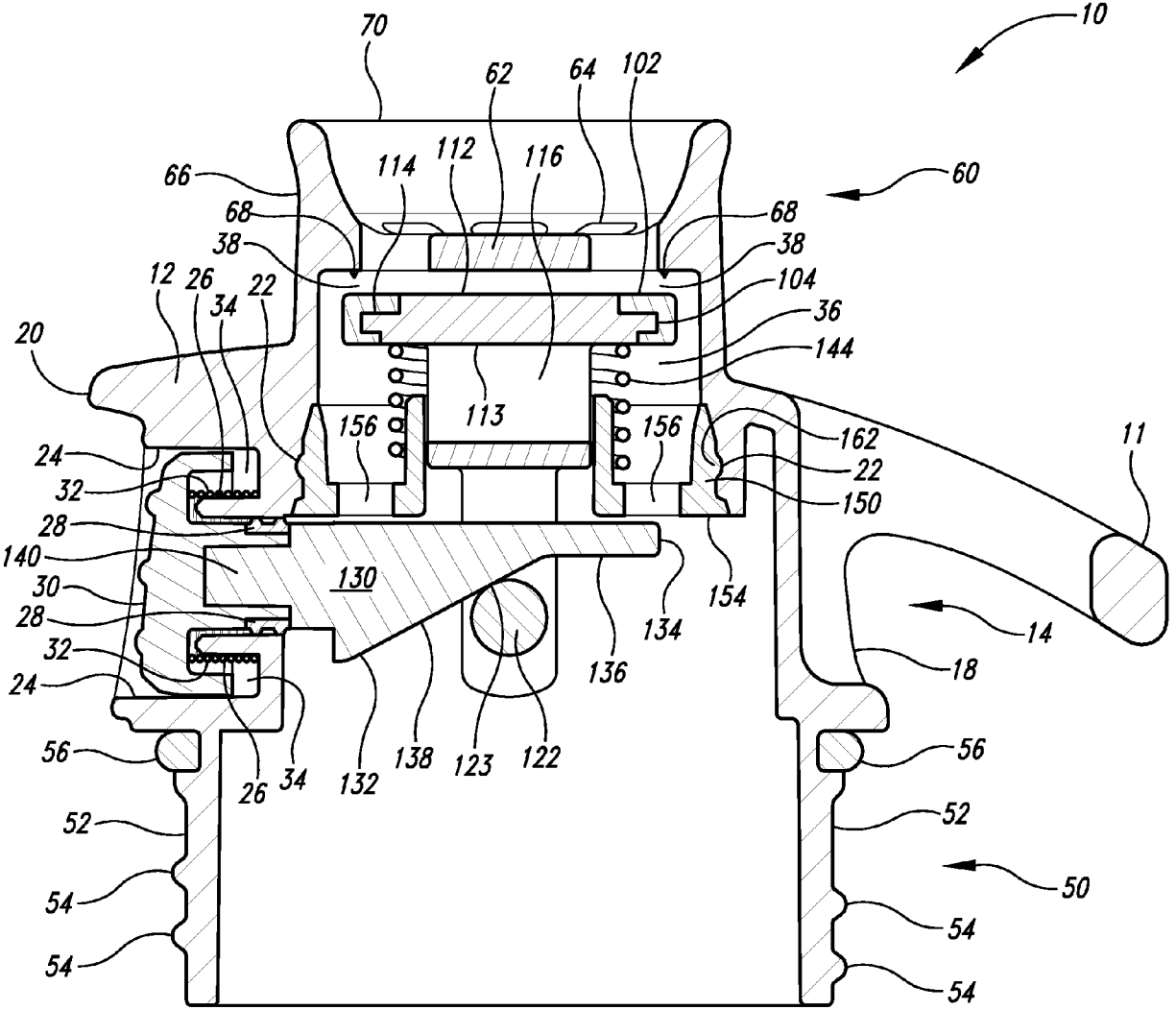
FIG. 9 is a cross-sectional left side elevational view of the beverage container closure of FIG. 1 when the stopper is in the open position.
Figure 10:
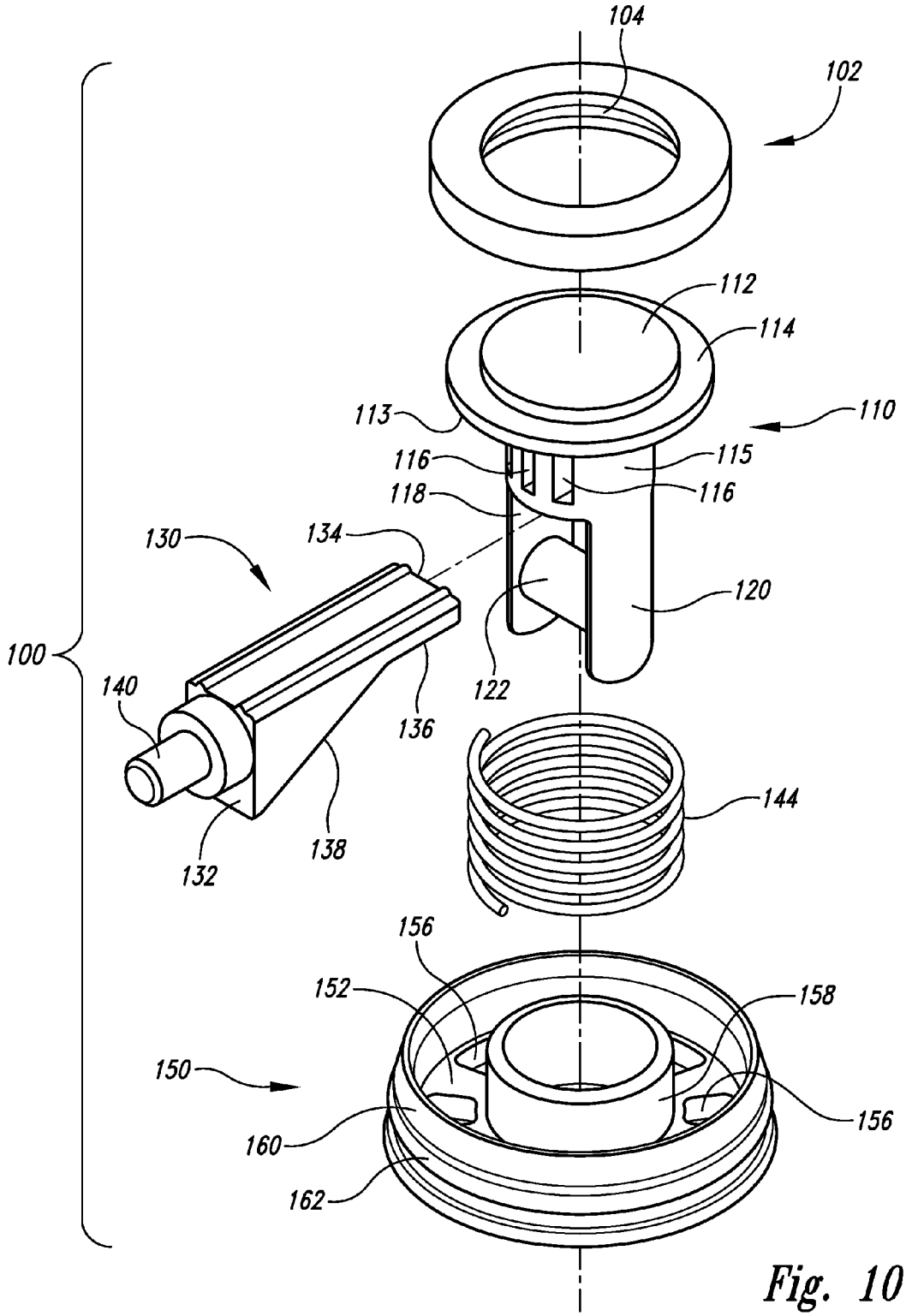
FIG. 10 is an exploded perspective view of a stopper assembly of the beverage container closure of FIG. 1.
Figure 11:
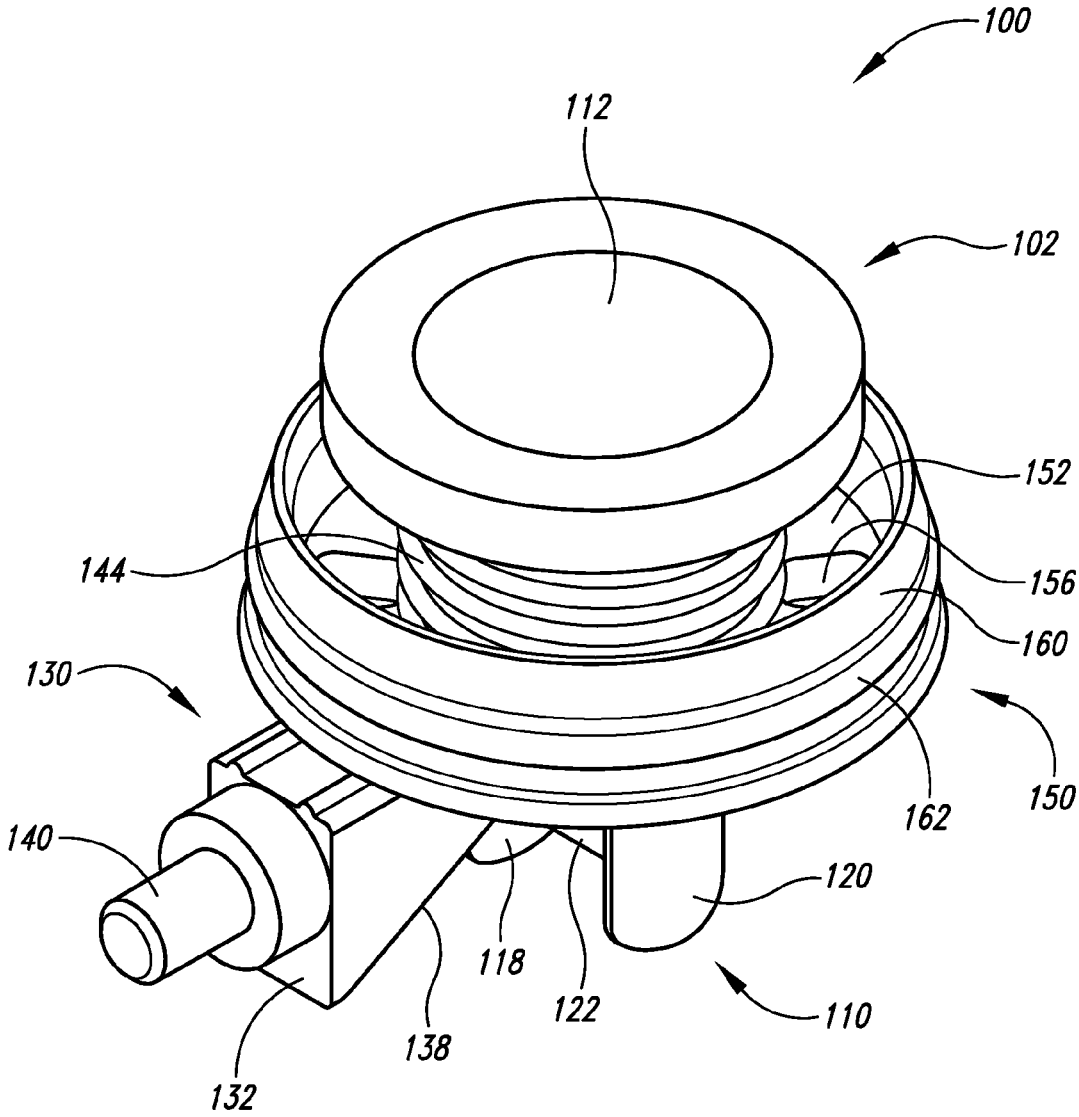
FIG. 11 is a perspective view of the stopper assembly shown in FIG. 10.

Fluid communication between the top portion 60 and the interior of a beverage container is controlled by way of a selectively openable stopper assembly 100, which may best be viewed in FIGS. 10 and 11. The stopper assembly 100 includes a stopper 110 having a top portion 112 including an outer band 114 configured for engagement with a stopper seal 102. The stopper seal 102 may be formed from a flexible material and includes a groove 104 configured to receive an outer band 114 of the stopper 110, as best seen in FIGS. 8 and 11. Below the top portion 112 of the stopper 110 is a body portion 115 that includes a plurality of vents or slits 116 disposed therein (see FIG. 8). Further, extending in a downward direction from the body portion 115 of the stopper 110 are two opposing sidewall portions 118 and 120 configured to support a crossbar 122 extending therebetween. As discussed in further detail below, the crossbar 122 is configured to engage a lever 130 such that the stopper 110 may be vertically displaced to selectively position it in an open position (shown in FIG. 9) or a sealed or closed position (shown in FIG. 8).

The stopper assembly 100 also includes a stopper cover 150 configured for retaining the stopper seal 102 within a hollow interior region 36 of the main body 12 (see FIGS. 8 and 9). The stopper cover 150 includes a base portion 152, a raised inner circumferential sidewall 158, and a raised outer circumferential sidewall 160. The base portion 152 includes a plurality of spaced apart apertures or openings 156 disposed therein and located between the inner and outer sidewalls 158 and 160 to allow for fluid passage therethrough. Further, the outer sidewall 160 comprises an engagement portion (e.g., a ridge) 162 to permit the stopper cover 150 to engage with a stopper cover engagement portion 22 of the main body 12 in a snap fit arrangement, thereby securing the stopper cover 150 (and the other components of the stopper assembly 100) to the main body 12 of the lid 10.

The stopper assembly 100 further includes a stopper biasing member (e.g., a spring) 144 configured for biasing the stopper 110 in the closed position which provides a fluid-tight seal for the lid 10. The stopper biasing member 144 is sized to have a diameter that is slightly larger than the outer diameter of the inner sidewall 158, such that the stopper biasing member may be positioned over the inner sidewall and in contact with the base portion 152 and a bottom surface 113 of the top portion 112 of the stopper 110 (see FIG. 9).

The stopper assembly 100 further includes the lever 130 configured for acting on the stopper 110 to selectively move the stopper between the open position and the closed position. The lever 130 includes a lower horizontal surface 136 disposed near a distal end 134 and a lower cam surface 138 disposed near a proximal end 132. The cam surface 138 is a ramp shape angled downward toward the proximal end 132 of the lever 130. As described below, the horizontal surface 136 and the cam surface 138 engage the crossbar 122 of the stopper 110 to move the stopper between the open and closed positions. The lever 130 further includes a rod 140 disposed at the proximal end 132 sized and shaped to be inserted (e.g., press fit) into a recessed portion of a button 30 (see FIGS. 8 and 9) configured to permit a user to actuate the lever 130 by simply pressing the button inward.

The operation of the stopper assembly 100 is now described with reference to FIGS. 8 and 9, which show cross-sectional left side elevational views of the lid 10 when the stopper 110 is in the sealed or closed position (FIG. 8) and the open position (FIG. 9). As can be seen, the stopper assembly 100 is positioned within the hollow interior region 36 of the main body 12. In this embodiment, the ridge 162 of the stopper cover 150 is engaged with the stopper cover engagement portion 22 disposed in the hollow interior region 36 of the main body 12. For example, the stopper cover 150 may be press fit or "snapped" into the hollow interior region 36 of the main body 12 to retain the stopper cover and the other components of the stopper assembly 100.

As shown in FIG. 8, the stopper seal 102 is in contact with a circumferential stopper seal engagement portion 68 of the main body 12. In this regard, when the stopper 100 is in the closed position shown in FIG. 8, the stopper assembly 100 is pressed against the stopper seal engagement portion 68 by the biasing member 144 to provide a fluid-tight seal between a container to which the lid 10 is attached and the environment.

The lever 130 is situated such that the horizontal surface 136 near the distal end 134 is aligned over the crossbar 122 of the stopper 110 and the horizontal surface 136 is biased upward into engagement with the crossbar 122 by the biasing member 144. The proximal end 132 of the lever 130 is situated within an opening in a front portion 20 of the main body 12 formed by a circumferential wall 26 located between left and right side lateral sidewalls 16 thereof. In turn, the button 30 is coupled to the lever 130 to allow a user to actuate the lever by pressing on the button. A button biasing member (e.g., a spring) 32 is positioned over the circumferential wall 26 in a space 34 between the wall 26 and a concentric outer circumferential wall 24 of the main body 12. The button biasing member 32 is operative to bias the button 30 and the lever 130 to the laterally outward position shown in FIG. 8 which corresponds to the closed position of the stopper 110 and tends to bias the lever 130 toward that position. Further, a button ring seal member 28 may be disposed around the button 30 and inward of the circumferential wall 26 to provide a fluid-tight seal therebetween to prevent leakage to the environment.

In operation, a user may depress the button 30 which in turn causes the lever 130 to be displaced in a horizontal direction (from the left to the right in the views shown in FIGS. 8 and 9). As the lever 130 is displaced, the lower surfaces 136 and 138 slidably engage an upper portion 123 of the crossbar 122 of the stopper 110 acting as a cam and cam follower, respectively. Since the surface 138 slopes downward toward the proximal end 132 of the lever 130, the crossbar 122 and thus the stopper 110 are moved in a downward direction as the lever 130 is displaced inward, as shown in FIG. 9. As can be appreciated, as the stopper 110 is moved in a downward direction, a gap 38 is formed between the stopper seal 102 and the circumferential stopper seal engagement portion 68 of the main body 12 such that fluid may pass therethrough.

Since both the lever 130 and the stopper 110 are biased by the button biasing member 32 and the stopper biasing member 144, respectively, the stopper 110 automatically returns to the sealed or closed position once the user removes pressure from the button 30 and the stopper automatically returns to the closed position shown in FIG. 8. In this regard, the user may open and drink from a beverage container to which the lid 10 is attached using one hand by simply pressing the button 30 with a finger while consuming a beverage and releasing the button thereafter to reseal the container. As can be appreciated, the ability to open, drink from, and close a container using only one hand may be desirable for various active users including bicyclists, hikers, and the like.

The foregoing described embodiments depict different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality.

While particular embodiments of the present invention have been shown and described, it will be obvious to those skilled in the art that, based upon the teachings herein, changes and modifications may be made without departing from this invention and its broader aspects and, therefore, the appended claims are to encompass within their scope all such changes and modifications as are within the true spirit and scope of this invention. Furthermore, it is to be understood that the invention is solely defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.).

It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

Accordingly, the invention is not limited except as by the appended claims.

The invention claimed is:

1. A lid for use with a drinking vessel containing a liquid, comprising:

a main body selectively couplable to the drinking vessel, the main body including a drinking well portion having a base having first and second openings therein configured to permit fluid passage therethrough when the lid is coupled to the drinking vessel, the drinking well portion further comprising a cylindrical sidewall and a circumferential lip configured for contact with a user's lips when the drinking vessel is tipped toward the user such that the user may drink therefrom from any direction, the first and second openings being disposed in a spaced apart opposing relationship such that when the drinking vessel is tipped toward the user one of the first and second openings acts as a drinking opening allow in the liquid to pass therethrough and the other of the first and second openings acts as a vent opening allowing air to pass therethrough to allow a smoother flow of the liquid through the opening acting as the drinking opening;

a stopper coupled to the main body and configured for upward linear displacement along a central vertical axis passing through the center of a stopper seal of the stopper into a closed position wherein the stopper seal engages a bottom surface of the base of the drinking well portion and covers each of the first and second openings to prevent fluid passage therethrough, and downward linear displacement along the central vertical axis into an open position wherein the stopper seal is spaced apart from bottom surface of the of the base of the drinking well portion to allow fluid passage through the first and second openings; and a lever coupled to the stopper and the main body, wherein the lever is movable inward and outward along a horizontal axis and has a cam surface, and the stopper has a cam follower positioned on the central vertical axis that engages the cam surface of the lever, the cam surface moving the cam follower downward along the central vertical axis when the lever is moved inward along the horizontal axis by the user to pull the stopper downward along the central vertical axis into the open position, and allowing the cam follower to move upward along the central vertical axis when the lever is moved outward along the horizontal axis to allow the stopper to move upward along the central vertical axis into the closed position, the stopper being positioned above the cam follower so that the liquid between the stopper and the cam follower drains back into the drinking vessel when the stopper is moved into the closed position and the drinking vessel is moved into an upright position.

2. The lid of claim 1, further comprising:

a stopper biasing member coupled to the stopper and configured to bias the stopper into the closed position.

3. The lid of claim 2, wherein the stopper biasing member comprises a spring.

4. The lid of claim 1, further comprising:

a button disposed on a sidewall portion of the main body, the button being coupled to the lever such that a user may actuate the lever to move the lever inward by pressing the button.

5. The lid of claim 1, further comprising:

a cover disposed over the opening of the main body having a plurality of openings therein configured to permit fluid passage therethrough.

6. The lid of claim 1, further comprising:

a stopper biasing member coupled to the stopper and configured to bias the stopper upward into the closed position; and a lever biasing member operatively coupled to the lever and configured to bias the lever to move outward and allow the stopper biasing member to move the stopper upward into the closed position.

7. The lid of claim 6, wherein the lever biasing member comprises a spring.

8. The lid of claim 1, wherein the main body further comprises a handle having a loop portion.

9. The lid of claim 1, wherein the main body includes a lower portion having threads disposed thereon configured for threaded engagement with the drinking vessel.

10. The lid of claim 1, wherein the stopper seal is disposed around a perimeter of a portion of the stopper.

11. The lid of claim 1, wherein the lever comprises an angled ramp portion configured for slidable engagement with a portion of the stopper.

12. The lid of claim 1, further comprising:

a stopper biasing member coupled to the stopper and configured to bias the stopper into the closed position; and a lever biasing member coupled to the lever and configured to bias the lever into a position that corresponds to the closed position of the stopper.

13. A drinking vessel and lid assembly, comprising:

a drinking vessel; and a lid comprising:

a main body selectively couplable to the drinking vessel, the main body including an upper portion having a plurality of openings therethrough configured to permit fluid passage through the upper portion when the lid is coupled to the drinking vessel, the main body further comprising a top portion having a cylindrical sidewall extending upwardly from the upper or section such that the upper portion and the cylindrical sidewall together form a drinking well, the cylindrical sidewall having an uppermost portion forming a circumferential lip configured for contact with a user's lips when the drinking vessel is tipped toward the user such that the user may drink therefrom from any direction, at least a portion of the plurality of openings being disposed in a spaced apart opposing relationship such that when the drinking vessel is tipped toward the user, at least one of the plurality of openings acts as a drinking opening allowing the liquid to pass therethrough and at least one other of the plurality of openings acts as a vent opening allowing air to pass therethrough to allow a smoother flow of the liquid through the at least one opening acting as the drinking opening;

a stopper coupled to the main body and configured for upward and downward linear displacement along a central vertical axis passing through the center of a stopper seal of the stopper between a closed position wherein the stopper seal engages a portion of the main body and covers each of the plurality of openings to prevent fluid passage therethrough such that the drinking well retains any liquid disposed therein, and an open position wherein the stopper seal is spaced apart from the portion of the main body to allow fluid passage through the plurality of openings; and a lever coupled to the stopper and the main body, wherein the lever is movable inward and outward along a horizontal axis and has a cam surface, and the stopper has a cam follower positioned on the central vertical axis that engages the cam surface of the lever, the cam surface moving the cam follower downward along the central vertical axis when the lever is moved inward along the horizontal axis by the user to pull the stopper downward along the central vertical axis into the open position, and allowing the cam follower to move upward along the central vertical axis when the lever is moved outward along the horizontal axis to allow the stopper to move upward along the central vertical axis into the closed position, the stopper being positioned above the cam follower so that the liquid between the stopper and the cam follower drains back into the drinking vessel when the stopper is moved into the closed position and the drinking vessel is moved into an upright position.

14. The drinking vessel and lid assembly of claim 13, further comprising:

a stopper biasing member coupled to the stopper and arranged to bias the stopper into the closed position when the lever is moved outward.

15. The drinking vessel and lid assembly of claim 14, further comprising:

a lever biasing member arranged to bias the lever outward.

16. A lid for use with a drinking vessel containing a liquid, comprising:

a main body selectively couplable to the drinking vessel, the main body including an upper portion having an opening configured to permit fluid passage therethrough when the lid is coupled to the drinking vessel, a centrally-positioned passage centered along a central vertical axis and formed by one or more guide sidewalls terminating at a lower end, a lower portion configured for engagement with the drinking vessel and including an unobstructed space portion below the lower end of the centrally-positioned passage that extends across substantially a width of the lower portion;

a stopper partially disposed within the centrally-positioned passage and configured for vertical linear displacement along the central vertical axis passing through the center of a stopper seal of the stopper between a closed position wherein the stopper seal engages a portion of the main body and covers the opening to prevent fluid passage therethrough, and an open position wherein the stopper seal is spaced apart from the portion of the main body to allow fluid passage through the opening, the stopper seal of the stopper being positioned above the centrally-positioned passage;

a stopper biasing member coupled to the stopper and configured to bias the stopper into the closed position;

a lever coupled to the main body that is movable inward and outward along a horizontal axis extending through the unobstructed space below the lower end of the centrally-positioned passage, the lever has a cam surface, and the stopper has a cam follower positioned on the central vertical axis below the stopper seal and below the lower end of the centrally-positioned passage that engages the cam surface of the lever, the cam surface moving the cam follower downward along the central vertical axis when the lever is moved inward along the horizontal axis by the user to pull the stopper downward along the central vertical axis into the open position, wherein the cam surface is moved inward along the horizontal axis to a position whereat the cam surface is beyond the central vertical axis, the cam surface allowing the cam follower to move upward along the central vertical axis when the lever is moved outward along the horizontal axis to allow the stopper to move upward along the central vertical axis into the closed position; and a lever biasing member coupled to the lever and configured to bias the lever outward to a second lever position corresponding to the closed position of the stopper.

17. The lid of claim 16, further comprising:

a button disposed on a sidewall portion of the main body, the button being coupled to the lever such that a user may press on the button to move the lever inward.

18. The lid of claim 16, wherein the stopper biasing member and the lever biasing member comprise springs.

* * * * *